US005117755A

United States Patent [19]

Fina

[11] Patent Number: 5,117,755

[45] Date of Patent: Jun. 2, 1992

[54] METHOD FOR FIXING PRINTING PLATES ONTO A CYLINDER OF AN INTAGLIO PRINTING MACHINE AND INSTALLATION FOR IMPLEMENTATION OF THE METHOD

[75] Inventor: Raffaele Fina, Lausanne, Switzerland

[73] Assignee: De La Rue Giori S.A., Lausanne, Switzerland

[21] Appl. No.: 531,117

[22] Filed: May 31, 1990

[30] Foreign Application Priority Data

Jun. 14, 1989 [CH] Switzerland ..... 2232/89

[51] Int. Cl.[5] ..... B41F 27/06; B41L 29/06

[52] U.S. Cl. ..... 101/486; 101/415.1

[58] Field of Search ..... 101/415.1, 378, 401.1, 101/375, 485, 486

[56] References Cited

U.S. PATENT DOCUMENTS 1,461,068 7/1923 Regensteiner ..... 101/415.1

2,619,904 12/1952 Mosegaard ..... 101/415.1

FOREIGN PATENT DOCUMENTS 1389192 6/1986 France .

*Primary Examiner*—J. Reed Fisher

*Attorney, Agent, or Firm*—Kane, Dalsimer, Sullivan, Kurucz, Levy, Eisele and Richard

[57] ABSTRACT

In order to fix two plates (3, 4) onto the cylinder formed by a sleeve (1) or by a plate cylinder of the intaglio printing machine, two axial grooves (2) are formed on the cylinder such that the plane of one of the lateral faces of each groove (2) forms an angle with the axis of the cylinder. A strip (5, 6), whose face adjacent to the end of the plate is perpendicular to said plate, is welded onto the concave face of the two ends of each plate (3, 4). The edge of each plate (3, 4) projecting beyond the corresponding strip (5, 6) is then cut off such that the edge of the plate forms a continuous surface with the face of the strip, and such that the sum of the lengths of the plates equals the length of the periphery of the cylinder. The plates are then arranged on the cylinder (1) by introducing the neighboring strips (5, 6) into a groove (2) and the free space in the groove is completed by a wedge-shaped strip (7) in order to tension the plates and obtain an edge-to-edge join.

8 Claims, 4 Drawing Sheets

METHOD FOR FIXING PRINTING PLATES ONTO A CYLINDER OF AN INTAGLIO PRINTING MACHINE AND INSTALLATION FOR IMPLEMENTATION OF THE METHOD

FIELD OF THE INVENTION

The present invention relates to a method for fixing printing plates onto a cylinder formed by a sleeve or a plate cylinder of an intaglio printing machine, and an installation for the implementation of the method.

PRIOR ART

In the field of printing, the term "plate cylinder" is understood to mean the unit consisting of the body of the cylinder which carries the printing plates and the shaft with which this body of the cylinder is integral, and the term "sleeve" is understood to mean simply the tube or the cylindrical shell without the shaft. Plate cylinders are generally used in sheet-fed printing machines and must be installed as a unit in the bearings of the machine or disassembled completely from the machine, respectively, by removing the shaft from the bearings, while the sleeves, used generally in web-fed printing machines, may simply be mounted on the shaft, or disassembled from their shaft, respectively, the printing plates being mounted on the sleeve before it is mounted on the shaft.

Since the present invention refers to both plate cylinders and sleeves, it has been agreed to use the term "cylinder" in order to define both when they are referred to in a general manner in the description and in the claims.

For intaglio printing, this cylinder which carries the plates must meet certain very strict requirements which guarantee, on the one hand, the sharpness of the printing and, on the other hand, perfect register between the various images. The main requirements are as follows:

The printing plates, after being fixed onto the periphery of the cylinder, must be situated edge-to-edge without any gap between them and thus form a continuous surface in order to prevent shocks on this surface caused by the very high pressures to which the cylinder is subjected during the wiping and printing, which shocks risk causing deformations of the printing plates, in particular under the influence of the tangential forces caused by the rolling of the two cylinders in contact. Furthermore, this continuous peripheral surface is necessary in the case of web-fed printing machines so as to obtain continuous printing without any losses of paper.

Perfect concentricity of the cylinder must also exist so as, on the one hand, to ensure perfect wiping after inking and, on the other hand, in order to prevent an irregular pressure on the cylinder during printing or wiping which would tend, during these operations, to deform the mounted printing plates.

For reasons of economy, the sleeve should be reused in web-fed printing machines by fixing other printing plates to it as, since its inner bore is slightly conical in order to match perfectly the corresponding conical shape of the shaft of the machine on which it is fixed during the printing, the manufacture of this sleeve requires extremely accurate machining and the manufacturing cost is very high.

A manufacturing method has been proposed in U.S. Pat. No. 4,224,095 consisting in adhesively bonding the bent printing plates to a sleeve such that there is no discontinuity. To do this, a hollow cylindrical mold is used, consisting of two shells and the internal diameter of which is equal to the external diameter of the plate sleeve to be obtained. A printing plate is placed inside the first shell and the sleeve, provided with a film of glue, is then positioned, and the second plate, and subsequently the second shell, is placed on the sleeve. Heat is applied in order to soften the glue, the sleeve is expended radially such that the plates are pressed against the mould, the glue is allowed to harden and the plate sleeve is removed from the mould. The radial expansion is obtained by introducing an expansion cone into the conical bore of the sleeve.

This method is an advantageous alternative to the known prior art methods, in particular the production of a printing plate by the transfer method, in other words transferring by rolling a roll with a profile corresponding to the plate over the sleeve, or alternatively by galvanic methods.

These known methods, however, remain fairly expensive.

In the European Patent Application EP-A 0,211,450, a method is proposed for fixing plates onto the sleeve in the following manner: at least two printing plates are prepared, the sum of the lengths of which is equal to the circumference of the sleeve and they are bent. The sleeve is expanded radially by mechanical means such that its external diameter, after the plates have been fixed, is equal to the diameter which it is to have in the printing machine. The printing plates are then fixed onto the sleeve by means of an adhesive film by arranging a steel clamping band successively around each printing plate, which band completely covers this plate, the zones of the two ends of the band being tangential to the periphery of the sleeve, and by applying tensile forces, orthogonal to the axis of the sleeve, to these two ends of the band. The grooves between the plates are subsequently filled and machining is carried out in order to obtain a continuous surface. Lastly, the application of the force causing the expansion of the sleeve is discontinued and the sleeve returns to its initial dimensions.

Although this method is satisfactory, the sleeve, before the plates are fixed, must be expanded radially and the fixing takes place plate after plate, waiting each time for the glue to harden; furthermore, the grooves between the plates must subsequently be filled in and machined in order to obtain a continuous peripheral surface.

SUMMARY OF THE INVENTION

The object of the present invention is to propose a method for fixing intaglio printing plates onto a plate cylinder or onto a sleeve in an easier manner such that, upon fixing, grooves which have to be filled in between the edges of the plates are avoided, without their being any need to expand the plate cylinder or the sleeve.

In order to achieve this object, the method according to the invention is defined in that:

a. the same number of regularly distributed axial grooves are formed on the peripheral surface of the cylinder as there are printing plates to be fixed;

b. one or more printing plates are prepared, the length of which, or the sum of the lengths of which, respectively, is greater than the circumference of the cylinder and each printing plate is bent with a radius of curvature less than that of the peripheral surface of the cylinder;

c. a strip is fixed close to two ends of each printing plate on the concave face; the face of said strip adjacent to the end of the plate being perpendicular to the latter and the positions of said strips being such that the length of the plate, or the sum of the lengths of the plates, respectively, between said faces of said strips equals the circumference of the cylinder;

d. the edge of each plate projecting beyond the corresponding strip is cut off such that the edge of the plate forms a continuous surface with the face of the strip;

e. the printing plate or plates are arranged on the peripheral surface of the cylinder by introducing the strips on two adjacent ends of the printing plate or plates, respectively, into a groove and the free space of the groove is completed by means comprising at least one wedge-shaped strip in order to tension plate or plates against the surface of the cylinder and to obtain, by compression, a join between the adjacent ends of the plate or plates, respectively, and their fastening.

The advantages of this method are as follows: the preparation of the printing plates takes place in the conventional manner, with the exception that when these plates are bent, the radius of curvature is less than that of the cylinder on which the plate is to be fixed. The operations of fixing the strips, as well as of preparing the grooves on the surface of the cylinder and the means intended to be housed in these grooves are performed before the plates are fixed onto the cylinder and therefore have no influence on the working time taken for the actual fixing of the plates.

The positioning of the plates takes place quickly since the strips with which the two ends of each plate are provided need only be introduced into the corresponding grooves in order to obtain the desired clamping by said means, at least one of which is in the shape of a wedge. By inserting the strip or strips in the shape of a wedge into the grooves, on the one hand a very close contact is ensured between the adjacent ends of two plates, which enables any subsequent filling-in and grinding work to be avoided and, on the other hand, a tensile force is exerted on the plates which intimately match the peripheral surface of the cylinder. The fixing of the plates therefore takes place more quickly than with the conventional methods; the results obtained in terms of the requirements for the quality of the fixing and of the printing obtained are at least as good as those obtained with the conventional methods which require more time and which are more expensive.

The method according to the invention may be used for-fixing intaglio plates onto both a sleeve for web-fed printing and onto a plate cylinder for sheet-fed printing. For sheet-fed printing in particular, this manner of fixing the plates enables the empty zones between two consecutive plates to be avoided.

In order to prevent the printing plates from deforming under the action of the tensile forces in the peripheral direction and the compressive forces to which they are subjected during printing, axial forces are also preferably applied in order to counteract the effects of these forces.

Although in the above text we have always referred to plates in the plural, the invention also refers to the case where the cylinder is intended to carry a single plate.

The invention also relates to an installation for the implementation of the method, which installation is defined by the fact that the cylinder is provided, on its peripheral surface, with the same number of regularly distributed axial grooves as there are printing plates to be fixed on said cylinder, and several elements are provided for each groove which are dimensioned such that, when mounted in this groove, they exactly complete the missing part of the cylinder, said elements comprising two strips and at least one element in the shape of a wedge, said strips intended to be joined horizontally with their lateral faces are fixed on the ends and on the lower side of the plate or plates, respectively, the edges of which are intended to be arranged end to end, said element in the shape of a wedge being arranged in said groove so as to be displaceable in the axial direction and interacting with its tapered face with a counterface provided on one of the other elements or on a wall of said groove such that, by pushing this element in a shape of a wedge axially, it exerts a force in the peripheral direction in order to tension the two ends of the plate situated at the height of this groove.

BRIEF DESCRIPTION OF THE DRAWINGS

The invention will be described in more detail with reference to the attached drawings.

DESCRIPTION OF THE PREFERRED EMBODIMENTS

Figure 1:
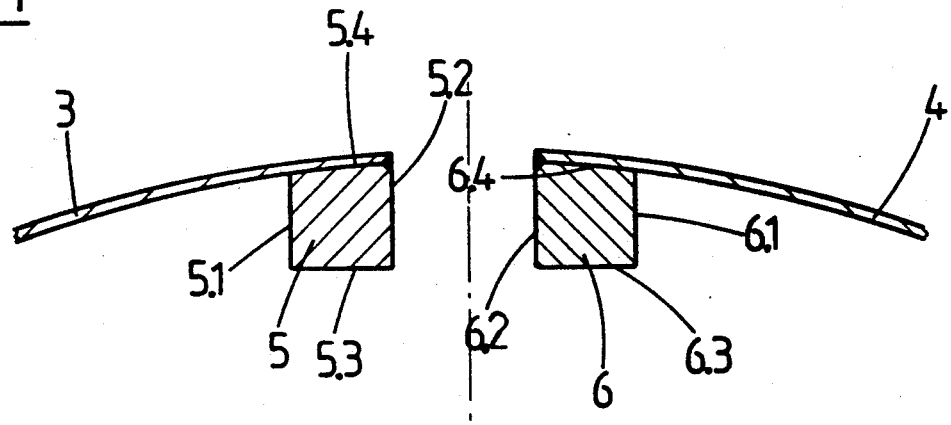
FIG. 1 is a partial view in cross-section of two printing plates provided with two fixing strips.
Figure 2:
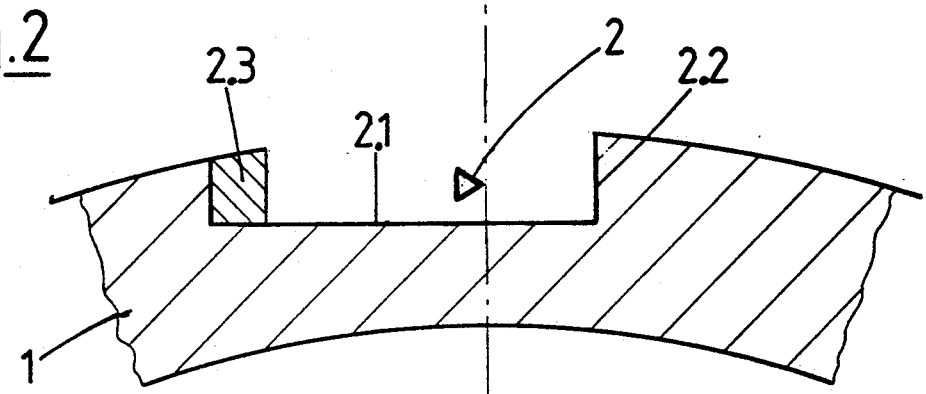
FIG. 2 is a partial view in radial cross-section of a sleeve provided with a groove for positioning the fixing strips according to a first alternative.
Figure 3:
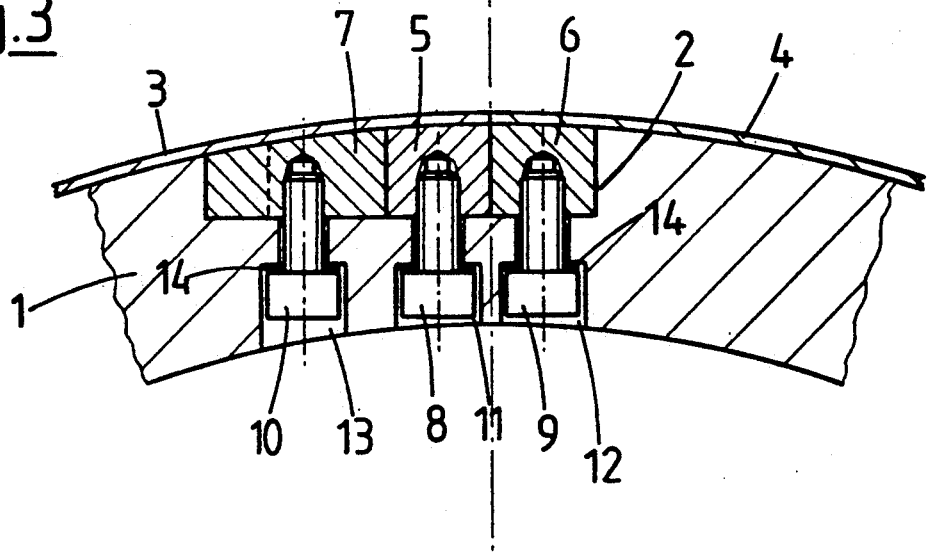
FIG. 3 is a partial view in radial cross-section of the sleeve according to FIG. 2, provided with two intaglio printing plates which are fixed according to this first alternative.

According to FIGS. 1 to 3, the same number of axial grooves 2 (FIG. 2) as intaglio printing plates which are to be fixed thereto are formed on the peripheral surface of a sleeve 1. In the example shown, two printing plates 3 and 4 have been chosen which are to be fixed onto the sleeve 1. In FIG. 1, only the ends of two plates 3 and 4 have been shown, the two other ends of the plates being symmetrical and prepared identically. The groove 2 (FIG. 2) made by accurate milling and machining is formed so as to have, firstly, an absolutely flat base 2.1 and two walls 2.2 and 2.3 perpendicular to the base 2.1. The wall 2.2 is parallel to the axis of the sleeve, whereas the wall 2.3 is inclined relative to the axis of the sleeve, thus forming a wedge-shaped groove.

Metal strips 5 and 6 are prepared which will be fixed to those ends of two plates 3 and 4 which are parallel to the axis of the sleeve, as well as similar strips for the other ends of two plates 3 and 4. Each of the strips, which are identical, has two faces 5.1, 5.2, and 6.1, 6.2, respectively, which are mutually parallel and perpendicular to a third face 5.3, and 6.3, respectively, which third face will come into contact with the flat base 2.1 of the groove 2. The upper faces 5.4 and 6.4, respectively, of the strips 5 and 6 are curved and matched to the curvature of the peripheral surface of the sleeve 1. A third wedge-shaped strip 7 (FIG. 3) is also formed such that, when mounted, the three strips 5, 6, 7 exactly fill the groove 2 such that the space occupied by these three strips in this groove exactly completes the missing part, removed by milling, of the sleeve 1. The arrangement in groove 2 is such that the face 6.1 of the strip 6 comes into contact with the face 2.2, while the faces 5.2 and 6.2 of the two strips 5, 6 are in close contact; the wedge-shaped strip 7 used as quoin has an inclined lateral face matched to the inclination of the wall 2.3 of the groove 2 and an upper face matched to the curvature of the surface of the sleeve 1; its dimensions enable the remaining space of the groove 2 (FIG. 3) to be filled after the strips 5 and 6 has been positioned.

The printing plates 3 and 4, after having been prepared by known means and each having a length slightly greater than half the periphery of the sleeve 1, are bent with a radius of curvature less than that of the radius of the sleeve. The strips 5, 6 as well as the corresponding strips at the opposite ends, are then fixed onto the ends of two plates 3, 4 preferably by laser welding, which prevents any deformation of the printing plates. This fixation is made in such a way that the length of plate 3 between the face 5.2 of the strip 5 and the corresponding face of the strip at the other end of plate 3 is equal to half the periphery of sleeve the same holds for the other plate 4; this means that the length of all plates between the faces 5.2 and 6.2 is equal to the periphery of the sleeve 1. After, the end of each of the plates is machined so as to form a continuous surface between the face 5.2 and the end of the plate 3, as well as between the face 6.2 and the end of the plate 4.

When this work has been completed, each plate is placed on the sleeve 1 such that the strips 5, 6, as well as the strips situated at the ends, which have not been shown, occupy the groove 2, or the groove situated in the diametrically opposite position of the sleeve 1, as has already been described. The fact that the two plates have been bent with a radius of curvature less than that of the sleeve enables the plates to remain in place by the clamping obtained as a result of this difference in radius of curvature. When the two adjacent ends of two plates 3 and 4 are situated exactly in the desired position, the third wedge-shaped strip 7 is introduced into the groove 2 and, by pushing it as far as possible, the two strips 5 and 6 are brought into close contact by their respective faces 5.2 and 6.2, as are consequently the respective ends of plates 3 and 4. The same operations are performed in the diametrically opposite groove, which enables, on the one hand, the plates to be tensioned against the peripheral surface of the sleeve and, on the other hand, a very close contact to be ensured between the ends of the two plates 3 and 4.

The clamping forces obtained by introducing the wedge-shaped strip 7 are substantial and based on the principle of wedge forces which is used in various applications such as, for example, the clamping of tool handles, for cutting down a tree trunk, cutting a log, etc.

The positioning and the compressive force on the wedge-shaped strip 7 may be realized by any device, but so as not to exceed a force which could cause deformation or destruction of both the sleeve and the plate 3 situated above the strip 7, the introduction and especially the clamping is effected by an appropriate device such as a micrometer screw or a system employing a jack, the force of which is controlled. When the strip 7 is sufficiently introduced into the groove 2 and when the desired clamping has been obtained, the three strips 5, 6, 7 (FIG. 3) are locked in the final position by means of three screws 8, 9, 10 which are arranged in passages 11, 12, 13 passing through the sleeve 1 and which are perpendicular to the base 2.1 of the groove 2. The sealing between the inside of the sleeve 1 and the outer surface, and in particular the groove 2, is ensured by seals 14 arranged between the screw heads 8, 9, 10 and the corresponding shoulders of the passages 11, 12, 13. Several screws may, of course, be used, arranged axially in order to ensure the locking of strips 5, 6, 7 but the number of screws, and in particular the number of passages used must not weaken the strength of the sleeve 1. It is understood that the diametrically opposite strips serving to fix the second end of the two plates are fixed and locked by similar means.

The clamping of the two plates in the peripheral direction which is obtained by means of the method described enables close contact between the ends of two consecutive plates 3 and 4, and no subsequent intervention is necessary to ensure continuity of the peripheral surface of the sleeve.

It should be noted that, if the number of plates to be fixed onto the sleeve 1 numbers more than two, the same method may be used except that, in this case, supplementary grooves must be provided, for example if three intaglio plates are to be fixed onto the sleeve, three axial grooves must be provided regularly distributed over the surface of the sleeve, and the mounting will take place by following the same method.

In all cases, the clamping obtained by the method entails, in particular, a force in the peripheral direction on the printing plates, and of course the radial forces which result therefrom permit a close and uniform contact of printing plates with the surface of the sleeve. It should also be noted that the force applied to the plates is distributed regularly over the entire width of the plates as a result of its inherent construction, in other words the fixing of the strips to the ends of each plate.

Nevertheless, since these forces are only in the peripheral direction of the plates, they do not take into account any shrinkage in the width direction of the plates, in other words in the axial direction. Similarly, during printing, the plate is subjected to a high degree of compression which may also cause localized momentary deformation of the plate. In order to prevent such a shrinkage and such a deformation occurring, means have been provided enabling opposite axial forces to be exerted on the lateral edges of the printing plates, which will now be described using FIGS. 4 and 5.

The sleeve 1 is provided on both sides with two annular sectors **15*a*, 15*b* having the same diameter as it and situated in the extension of its lateral faces, one sector for each lateral edge of each plate 3, 4. When the printing plates 3, 4 are mounted, the tensioning of which in the peripheral direction is effected in the same way as that described with reference to FIG. 3, the lateral edges of these plates are fixed onto said sectors, as will be described later. Each sector 15*a*, 15*b* is mounted axially on the sleeve by regularly distributed screws 16 which are screwed into blind and tapped axial housings 17 in the end of the sleeve 1, while they pass freely through the sectors 15*a*, 15*b* such that each sector 15*a***, 15*b* is axially displaceable relative to the sleeve 1. Retention in the radial direction and guidance of these sectors are ensured by regularly distributed guides 18. They are formed by pins driven axially into axial blind passages 18*a* pin the lateral face of the sleeve, their size enabling them to slide in the holes provided in each sector 15*a*, 15*b*.

The screws 25 for positioning and laterally tensioning the plates are alternately arranged with the screws 16 and the guides 18, these screws 25 being screwed only onto the sectors 15*a*, 15*b* in tapped passages in the latter and penetrate into blind and opposite housings 20 and 21 extending axially, on the one hand, on the sleeve and, on the other hand, in the sectors 15*a*, 15*b* facing the sleeve 1. The screws 25 abut the base of the housings 20 and enable the printing plates to be positioned axially and the axial tension applied to the plates to be adjusted via said annular sectors. Helical springs 19 surrounding the screws 25 and bearing against the base of the housings 20 and 21 are housed in these blind housings 20, 21. These pressure springs ensure a constant force in the axial direction, therefore pushing the sectors outwards, the maximum clearance which may be obtained by these springs being limited by the position of the screws 16. The screws 16 enable the springs 19 to compress during the mounting or disassembly of the plates and the sectors 15*a*, 15*b* to be positioned axially, applying a lateral tensile force to the plates.

Tapped holes 22, in which screws 23 with milled heads may be screwed, are pierced radially over the periphery of each sector. During the positioning of the printing plates 3 and 4, the screws 16 are tightened in order to compress the springs 19. The lateral ends of these plates which are situated level with the sectors 15*a*, 15*b* have countersinks 24 into which the screws 23 on the corresponding sectors are screwed. The term countersinks is understood to mean a shape stamped into the plate and serving as a housing for the head of the screws which thus do not project from the plate (see the partial cross-section in FIG. 4). After the plate has been fixed via the screws 23, the screws 16 are loosened slightly so that the sectors 15*a*, 15*b* may yield under the action of the helical springs 19 which may thus act in traction on the plate. When the plates are clamped by means of the wedge-shaped strips 7, a force in the axial direction of the sleeve is thus also ensured by means of the springs 19, enabling the axial shrinkage to which the printing plates could be subjected to be counteracted and prevent a momentary localized deformation during printing. The sectors 15*a*, 15*b* have notches corresponding to the strips 7 in order to enable the latter to be positioned or withdrawn without having to remove the sectors.

Similarly, in order to facilitate the disassembly of the plate when it is desired to change it, these screws 16 are tightened again in order to compress the springs 19.

Figure 6:
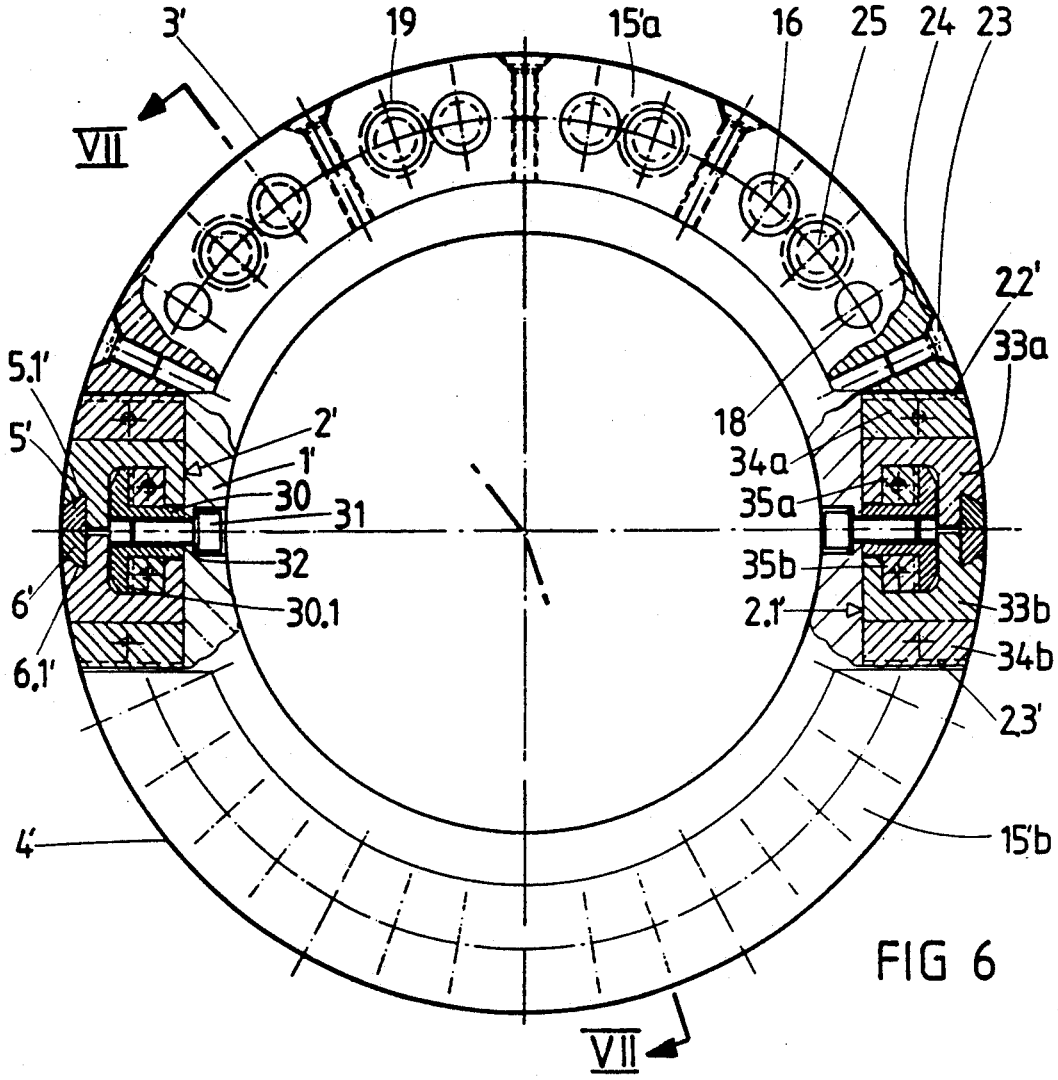
FIG. 6 is a view similar to that in FIG. 4 of a second alternative embodiment in the case of a sleeve.
Figure 7:
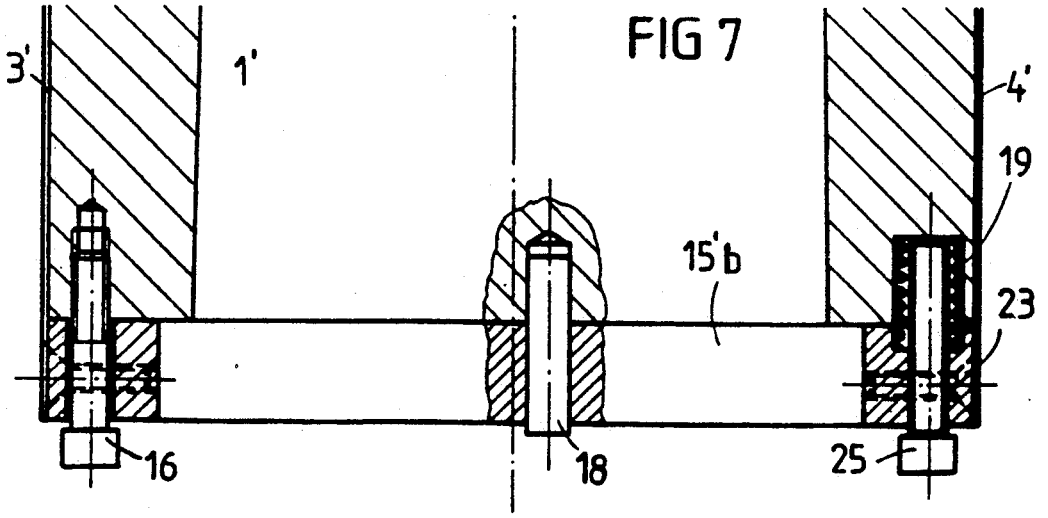
FIG. 7 is a view in cross-section along the line VII—VII in FIG. 6.

In FIGS. 6 and 7, another installation for fixing printing plates 3', 4' onto a sleeve 1, is shown, with a modified wedge-locking. Each groove 2, is symmetrical about a radial plane of the sleeve and perpendicular to the base 2.1' of the groove 2'. The two lateral faces 2.2' and 2.3' of the grooves 2' are inclined symmetrically about said radial plane. A T-shaped metal section 30 is arranged inside each groove and is fixed by screws 31 introduced through radial housings inside the sleeve 1', the sealing being ensured by O-ring seals 32, the lower face 30.1 of the metal section 30 being inclined relative to the plane of the base of the groove 2.1'.

Strips 5' and 6' at the ends of two printing plates 4' and 3' are fixed in the same manner as before except that their dimensions and shape are different. Indeed, the strips 5', 6' shown in FIG. 6 have a trapezoidal shape, each having an inclined face 5.1' and 6.1', respectively, and their height is less than the depth of the groove 2'.

In order to position the plates 3', 4', three pairs of removable strips are provided for each groove, namely 33*a*, 33*b*; 34*a*, 34*b* and 35*a*, 35*b*. The strips 33*a* and 33*b* have, on the one hand, a notch with a shape which combines with that of the strips 5' and 6' and, on their lower part, a housing enabling the metal section 30 to be partially encased, leaving a free space between the inclined face 30.1 of the metal section and the lower part of each of the strips 33*a*, 33*b*.

The strips 34*a*, 34*b*, 35*a*, 35*b* are wedge-shaped.

The positioning of the strips takes place in the following manner: the strips 33*a* and 33*b* are introduced into each groove 2', and the strips 5', 6' fixed to the ends of the plates 3', 4' are then placed therein, the wedge-shaped strips 34*a*, 34*b* are introduced in order to ensure the positioning in the peripheral direction of the strips, and consequently of the printing plates, as in the case of FIG. 3 et seq; so as to ensure the positioning of the unit in the radial direction, wedge-shaped strips 35*a* and 35*b* are introduced into said free space between the inclined face 30.1 of the metal section 30 and the lower part of each of the strips 33*a*, 33*b*, thus ensuring the retention of the unit in the radial direction.

Figure 4:
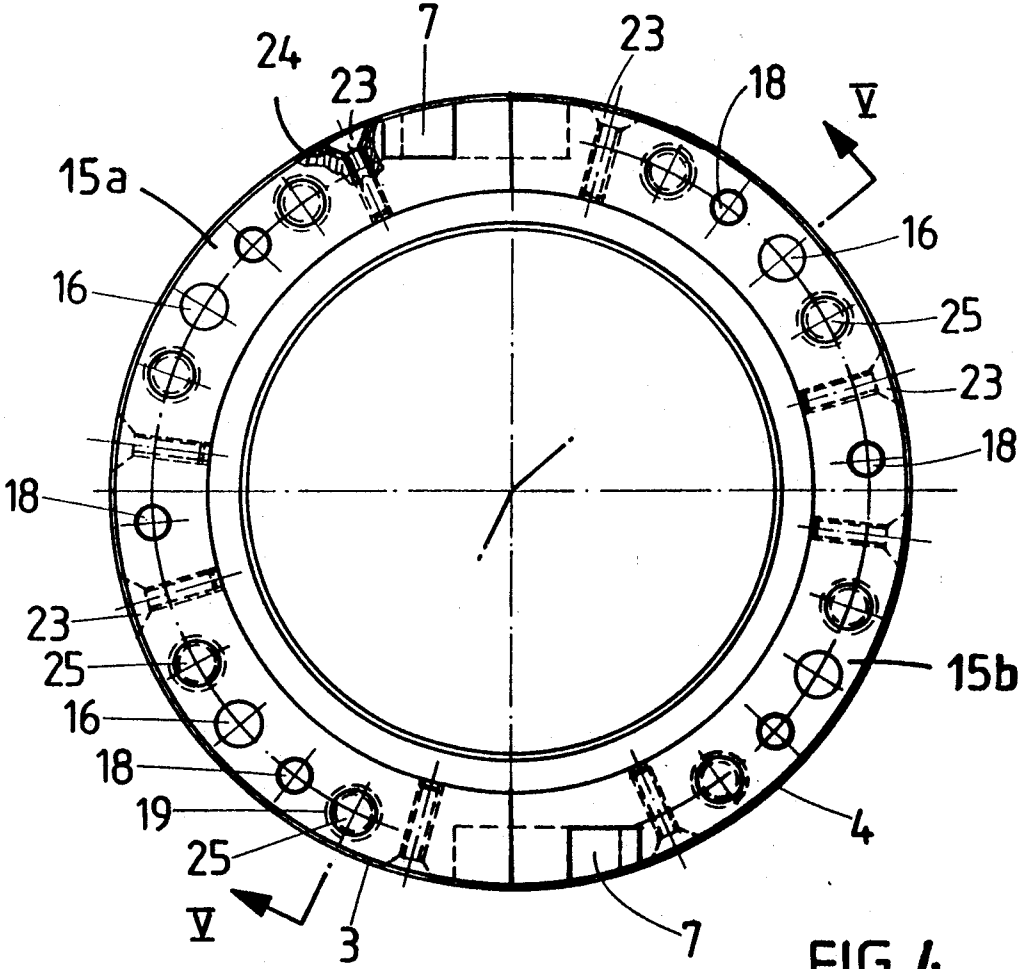
FIG. 4 is a lateral view of the sleeve provided with annular sectors in order to tension the plates axially.
Figure 5:
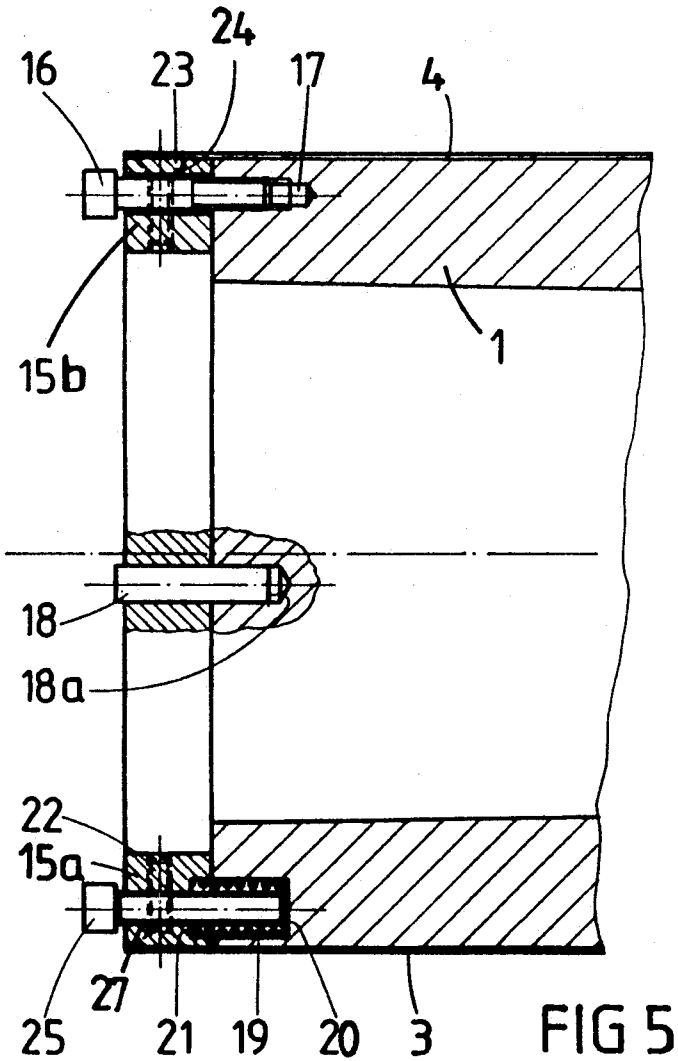
FIG. 5 is a view in cross-section along the line V—V in FIG. 4.

As in the first embodiment according to FIGS. 4 and 5, the sleeve 1' is provided on each side with two annular sectors 15'*a*, 15'*b*, mounted by means of three elements, screw 16, guide 18 and screw 25, which are arranged alternately such that these sectors create axial tensions.

Figure 8:
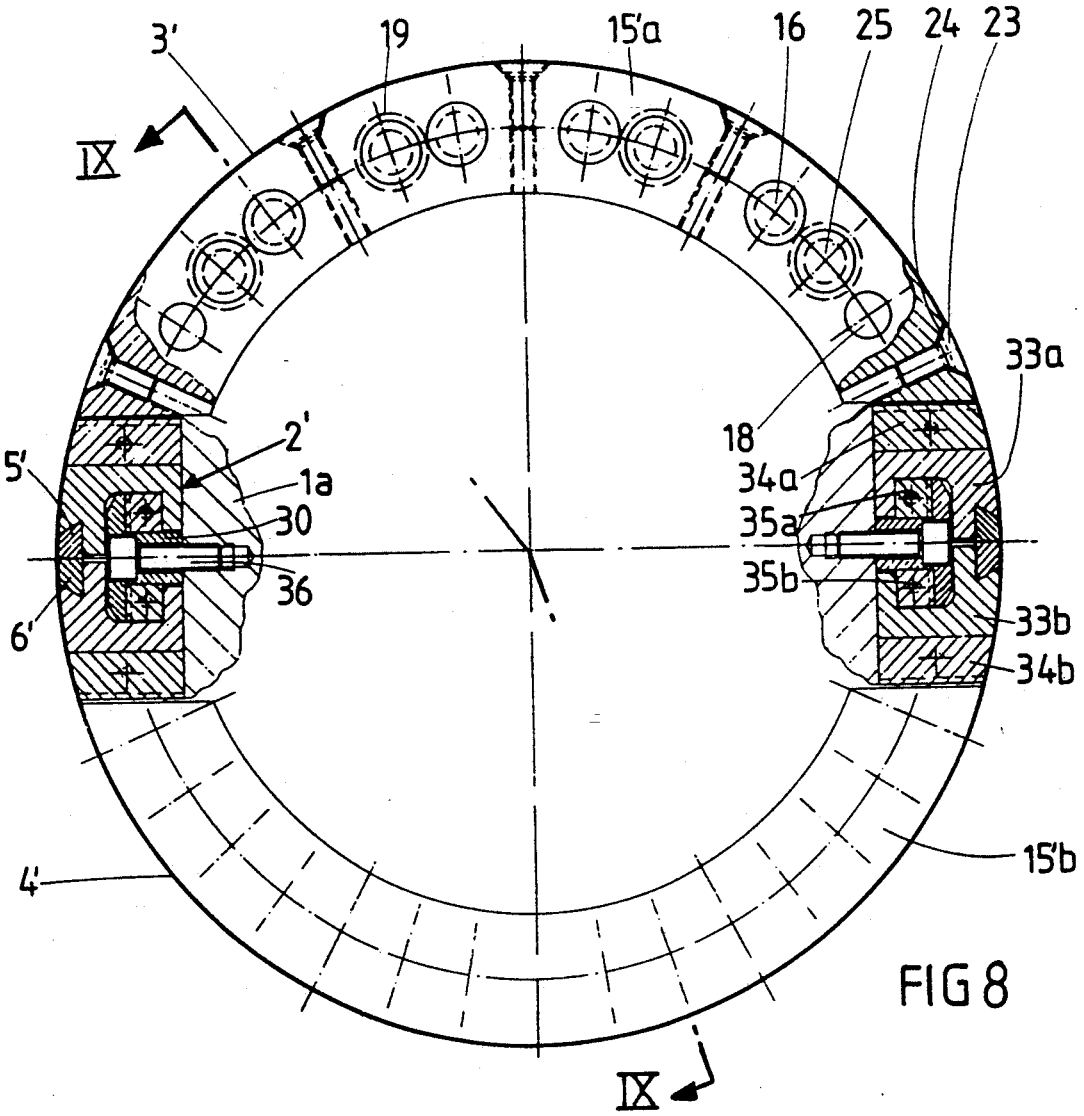
FIG. 8 is a lateral view of a plate cylinder provided with annular sectors in order to tension the plates axially.
Figure 9:
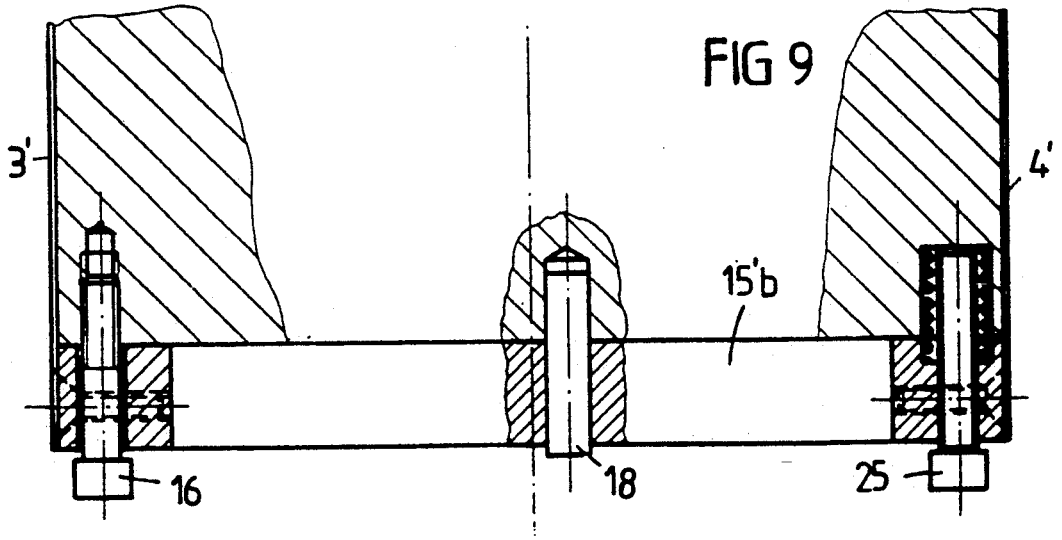
FIG. 9 is a view in cross-section along the line IX—IX in FIG. 8.

FIGS. 8 and 9 show a similar arrangement for fixing the printing plates 3', 4' onto a plate cylinder la, and therefore intended for a sheet-fed printing machine. In this case, because of the body of the cylinder mounted on its shaft, the fixing screws 36, which each fix a T-shaped metal section 30, and with the same configuration as that described with reference to FIG. 7, cannot be screwed from inside the cylinder but from outside. This is the only difference from FIGS. 6 and 7, the strips 5', 6', 33*a*, 33*b*, 34*a*, 34*b*, 35*a*, 35*b* being the same.

The device for fixing the plates in the axial direction shown in FIGS. 8 and 9 is formed in the same manner as that in FIGS. 5, 6 and 7 with two annular sectors 15'*a* and 15'*b* on each side, and the same means are represented by the same references.

If, after the printing machine has been functioning for a reasonably long period of time, the printing plates have undergone, because of the deformations mentioned, an expansion such that under the force of the helical springs exerting a permanent tension on the plates the screws 25 no longer abut the base of the housings 20, all the screws 25 are tightened again after the machine has come to a standstill in order to recover the play.

It is also possible to dispense with the helical springs 19 and, after the machine has been functioning for a certain time, if it proves necessary, the axial tension on the plates may be readjusted by retightening the screws 25.

If a cylinder has been provided with a single plate, under these conditions a closed annular sector, in other words a ring, is used for each lateral edge of the plate.

The invention is not limited to the embodiments described but also covers numerous possible alternatives.

I claim:

1. Method for fixing printing plates onto a cylinder formed by a sleeve (1, 1') or a plate cylinder (1*a*) of an intaglio printing machine, comprising the steps of:

a. providing the same number of regularly distributed axial grooves (2, 2') formed on the peripheral surface of the cylinder (1, 1'; 1*a*) as there are printing plates (3, 4; 3', 4') to be fixed;

b. preparing one or more printing plates (3, 4; 3', 4'), the length of which, or the sum of the lengths of which, respectively, is greater than the circumference of the cylinder (1, 1'; 1*a*) and each printing plate is bent with a radius of curvature less than that of the peripheral surface of the cylinder;

c. fixing a strip (5, 6; 5', 6') close to two ends of each printing plate (3, 4; 3', 4') on the concave face; the face of said strip adjacent to the end of the plate being perpendicular to the latter and the position of each said strip being such that the length of the plate, or the sum of the lengths of the plates (3, 4; 3', 4'), respectively, between said faces of said strips equals the circumference of the cylinder;

d. cutting off the edge of each plate (3, 4; 3', 4') projecting beyond the corresponding strip (5, 6; 5', 6') such that the edge of the plate forms a continuous surface with the face of the strip;

e. arranging the printing plate or plates (3, 4; 3', 4') on the peripheral surface of the cylinder by introducing the strips (5, 6; 5', 6') on two adjacent ends of the printing, plate or plates, respectively, into groove (2, 2') and the free space of the groove is completed by means comprising at least one wedge-shaped strip (7; 34*a*, 34*b*) in order to tension plate or plates in the peripheral direction against the surface of the cylinder and to obtain, by compression, joinder between the adjacent ends of the plate or plates, respectively, and their fastening;

f. fixing on the base (2.1') of the groove a member (30) enabling at least part of the said means completing the free space of the groove to be retained radially and having an inclined face turned radially towards the inside of said cylinder, and in which at least one other wedge-shaped strip (35*a*, 35*b*) cooperating with said inclined face of said member (30) is used in order to ensure the positioning of the said means (33*a*, 33*b*) and of the strips, (5', 6') in the radial direction inside the groove (2'); and g. after the strips, (5, 6; 5', 6') have been positioned inside the groove (2, 2'), applying axial tensile forces to the two peripheral edges of each printing plate (3, 4; 3', 4') in the opposite direction so as to tension the printing plates axially.

2. Fixing method according to claim 1, further comprising the step of providing the strips (5, 6; 5', 6') from metal and said step of fixing, each said strip (5, 6, 5', 6') on each printing plate (3, 4; 3', 4') comprises laser welding.

3. Fixing method according to claim 1, further comprising the steps of providing the plane (2.3) of one of the lateral faces of each groove (2, 2') to form an angle with the axis of the cylinder thereby forming an inclined face (2.3), and inserting the at least one wedge-shaped strip (7) into a space limited by said inclined face (2.3) of the groove (2).

4. Installation method for fixing printing, plates onto a cylinder formed by a sleeve (1, 1') or a plate cylinder (1*a*) of an intaglio printing machine comprising the steps of providing a cylinder (1, 1') with the same number of regularly distributed axial grooves (2) on its peripheral surface as there are, printing plates (3, 4) to be fixed on said cylinder (1, 1'), and providing several strips for each respective groove which are dimensioned such that, when mounted in said respective groove, said strips exactly complete the axial grooves of the cylinder, providing each said groove (2') with two lateral faces (2.2', 2.3') inclined relative to the axis of the cylinder symmetrically relative to the radial plane of the cylinder perpendicular to the base (2.1') of the groove (2'), a T-shaped metal section (30) is fixed, on the mid line of the base of the groove, the head of the metal section being directed towards the top of the groove, the lower face (30.1) of said head being inclined relative to the axis of the cylinder, and providing four pairs of strips per groove (2'), the first pair (5', 6') being fixed on ends and on the lower side of each plate, respectively, the edges of which are to be arranged end to end and each forms a continuous surface with a lateral face of the respective strip, said strips of said first pair to be joined horizontally with their lateral faces and having a trapezoidal cross-section, the second pair (33*a*, 33*b*) having, on its upper part, a female part which complements that of the strips (5', 6') which are fixed to each printing plate (3', 4'), and, on its lower part, a recess enabling the metal section (30) to be encased and a space to be left between the lower inclined face of the head of the metal section and the lower parts of the strips (33*a*, 33*b*), which space accommodates the third pair of strips (35*a*, 35*b*) having a wedge-shaped configuration with a shape which complements said space ensuring the retention in the radial direction of two pairs of said strips (5', 6'; 33*a*, 33*b*) by pushing said wedge-shaped strips (35*a*, 35*b*) axially; the fourth pair of strips (34*a*, 34*b*) having a wedged-shaped configuration slid in the axial direction between the second pair of strips (33*a*, 33*b*) and the lateral faces (2.2', 2.3') of each said groove (2') so as to exert a clamping force on the whole and to tension the printing plates in the peripheral direction.

5. The installation method as claimed in claim 4, further including the step of providing the cylinder (1, 1') at two lateral sides thereof with means for applying opposite axial forces to the lateral edges of each printing plate, said applying means comprising, for each lateral edge of each printing plate, an annular sector (15*a*, 15*b*, 15'*a*, 15'*b*), said annular sectors having the same external diameter as the cylinder and being provided with means to attach the lateral edges of each printing plate (3, 4; 3', 4') thereto and in order to be mounted on the lateral sides of the cylinder (1, 1', 1*a*) so as to be displaceable axially in order to apply tensile forces to the lateral edges of each printing plate in the axial direction.

6. The installation method as claimed in claim 5, further including the step of providing elastic means (19) between said annular sectors (15*a*, 15*b*; 15'*a*, 15'*b*) and the lateral sides of the cylinder (1, 1', 1*a*), said elastic means applying compressive forces tending to move apart said annular sectors (15*a*, 15*b*; 15'*a*, 15'*b*) of the cylinder (1, 1', 1*a*) axially.

7. The installation method as claimed in claim 6, further including the step of mounting said annular sectors (15*a*, 15*b*; 15'*a*, 15'*b*) on the sides of the cylinder (1, 11, 1*a*) by screws (16) which are screwed axially onto the cylinder and pass freely through the annular sectors in order to secure them axially in the absence of printing plates and in order to compress the elastic means (19)

when the printing plates are being mounted and disassembled, said annular sectors are guided axially by axial pins (18) and they comprise screws (25) which are screwed onto these annular sectors and abut the cylinder in order to enable the printing plates to be positioned axially and the axial tension applied to them via said annular sectors to be adjusted.

8. The installation method as claimed in claim 7, in which the elastic means are helical springs (19) surrounding said screws (25) screwed onto the annular sectors, and are housed in housings (20) provided in the cylinder and into which these screws (25) penetrate.

* * * * *